United States Patent [19]

Sims

[11] Patent Number: 4,883,011

[45] Date of Patent: Nov. 28, 1989

[54] HYDROFOIL KEEL

[76] Inventor: Merrick L. Sims, 7 Ilya Avenue, Bayview, New South Wales 2103, Australia

[21] Appl. No.: 9,646

[22] Filed: Jan. 27, 1987

Related U.S. Application Data

[63] Continuation-in-part of Ser. No. 647,140, Sep. 4, 1984, abandoned.

[30] Foreign Application Priority Data

| | | | |
|---|---|---|---|
| Sep. 5, 1983 | [AU] | Australia | PG1210 |
| Sep. 5, 1983 | [AU] | Australia | PG1211 |
| Sep. 19, 1983 | [AU] | Australia | PG1459 |
| Dec. 5, 1983 | [AU] | Australia | PG2681 |
| Jan. 2, 1984 | [AU] | Australia | PG3415 |
| Jul. 26, 1984 | [AU] | Australia | PG6226 |

[51] Int. Cl.[4] ..... B63B 3/38

[52] U.S. Cl. ..... 114/39.1; 114/140

[58] Field of Search ..... 114/127, 138, 139, 129, 114/140, 141, 125, 39.1

[56] References Cited

U.S. PATENT DOCUMENTS

| | | | |
|---|---|---|---|
| 3,304,898 | 2/1967 | Sainte-Claire | 114/125 |
| 4,089,286 | 5/1978 | Scheel | 114/140 |
| 4,280,433 | 7/1981 | Haddock | 114/127 |
| 4,316,425 | 2/1982 | Guido | 114/138 |

FOREIGN PATENT DOCUMENTS

| | | | |
|---|---|---|---|
| 32931-84 | 8/1984 | Australia . | |
| 32931/84 | 3/1985 | Australia . | |
| 2942071 | 4/1981 | Fed. Rep. of Germany | 114/140 |
| 2351003 | 12/1977 | France | 114/141 |
| 125378 | of 1919 | United Kingdom | 114/140 |
| 1293349 | 10/1972 | United Kingdom | 114/141 |
| 1383236 | 2/1975 | United Kingdom . | |

OTHER PUBLICATIONS

*Simple Aerodynamics,* 5th Ed., 1940, pp. 55, 64–65, Ronald Press Co., New York, N.Y.

Chambers's Technical Dictionary, Revised Edition, 1940, pp. 34–35, The Macmillan Company, New York, N.Y.

Marchaj, *Sailing Theory and Practice,* 1964, pp. 66, 86, Dodd Mead & Co., New York, N.Y.

*Primary Examiner*—Joseph F. Peters, Jr.

*Assistant Examiner*—Edwin L. Swinehart

*Attorney, Agent, or Firm*—Fitch, Even, Tabin & Flannery

[57] ABSTRACT

Disclosed ia a keel for a sailing boat having a hydrofoil section. The thickness to chord ratio of the keel increases from the top to the bottom creating a vortex trap and thus reducing the drag of the keel. A generally horizontal plate at the bottom of the keel is also disclosed and further reduces the drag induced by vortex shedding. In one form the camber of the keel is adjustable. The mechanism for adjusting the camber includes rotatable forward and aft sections faired to a center section of the keel by sheets with a length being a small portion of the total cordal length of the keel. The fairing sheets are fixed along one vertical edge and tensioned by rods located within the rotating forward and aft sections of the keel. The lifting surface area of the keel can be altered, in response to wind velocities outside of the design range, by using a sealed sleeve arrangement with a water filled hollow internal portion and controlling the volume of water filling that portion thus controlling the position of the sleeve and lifting area of the keel.

14 Claims, 6 Drawing Sheets

HYDROFOIL KEEL

This application is a continuation-in-part of application Ser. No. 647,140 filed Sept. 4, 1984, now abandoned.

This invention relates to improved keels used on sailing craft. Part of the disclosure to be given describes a variably camberable keel which is also applicable to other craft such as aircraft.

Although hydrofoil keels, with their higher lift coefficients and lift/drag ratios at lower angles of attack than conventional yacht underbodies, offer potential advantages in both reducing the leeway angle of, and increasing the net driving force available for, yachts when beating, and while keels of this type have been in limited use for some years, in both the camberless and camberable form, they have never achieved their full operational potential, due partly at least, to misconceptions and technical shortcomings, some of which are listed below.

1. It has been said that the extra drag induced by sections of thickness to chord ratio above 0.1 rendered them unsuitable for yacht work, a widely accepted rule of thumb being that the thickness should not exceed 1/11th of the chord. This rule is difficult to justify, since aerofoil data shows that the lift/drag ratio equivalent to a lift coefficient of 0.8 is about 16 for all camberless sections with thickness/chord ratios from 0.08 to 0.20 and that the lift coefficient corresponding to the maximum lift/drag ratio is actually higher in the thickness/-chord range from 0.1 to 0.2 than it is below it. The text below will show this fact to be most important.

2. Since it was known that a considerable percentage of the lift which would be generated by a foil of infinite aspect ratio would be lost through vortex shedding when the aspect ratio was less than 2, and since navigational conditions and racing rules limit the draughts of vessels and hence the aspect ratios of their keel to about the latter figure, it was thought that such keels must have low lifting efficiencies. Indeed some naval architects actively minimised the lifts of their underbodies on the grounds that lift induced vortex shedding which in turn induced drag.

3. As a corollary of the abovementioned draught restrictions, it was held that to generate the required lift, which is linearly proportional to the area of the lifting surface, chords would have to be relatively long, accentuating the vorticity problem, and by analogy with aircraft wings of similar chords, inducing stalling speeds far above those attainable by displacement yachts. For this reason many thought that such keels would be useless for yacht work.

4. The mechanisms previously developed for varying the chamber of the camberable version of the device, all resulted in lifting surfaces of very low rigidity, rendering them incapable of maintaining rigid sections under varying pressure loads and thus were incapable of performing their functions satisfactorily.

Therefore, it is an object of the present invention to provide a hydrofoil keel which will ameliorate disadvantages of the prior art.

Accordingly, in one broad form, the present invention may be said to consist in a keel having hydrofoil shape, the thickness/average chord ratio at a top end being about 0.08 and increasing to up to 0.2 at the foot of said keel.

In a further form of the invention there is provided a keel having hydrofoil shape, the ratio of the area of the lifting surface of said keel to the sail area of a boat on which said keel is adapted to operate, being approximately equal to the square of the ratio of the wind speed at the upper end of the wind speed range in which said keel is designed to operate, to the hull speed of said boat multiplied by the ratio of the lift coefficient of the sails at their setting giving the highest lift/drag ratio at the upper end of said wind speed range, to the lift coefficient of said keel at the angle of attack giving its highest lift/drag ratio, all divided by 800.

In a further form of the invention there is provided a hydrofoil shaped multi section variably camberable keel comprising a fixed center section, and cambering and fairing mechanisms restricted to the space available within respective rotatable forward and/or aft sections, said sections being faired to said fixed center section by means of flexible plates which are only a fraction of the overall chordal length of said keel, and said cambering and fairing mechanism controlling the rotational position of their respective rotational sections.

By way of example only, preferred embodiments of the present invention will now be disclosed with reference to, and as illustrated by, the accompanying drawings in which.

Figure 1:
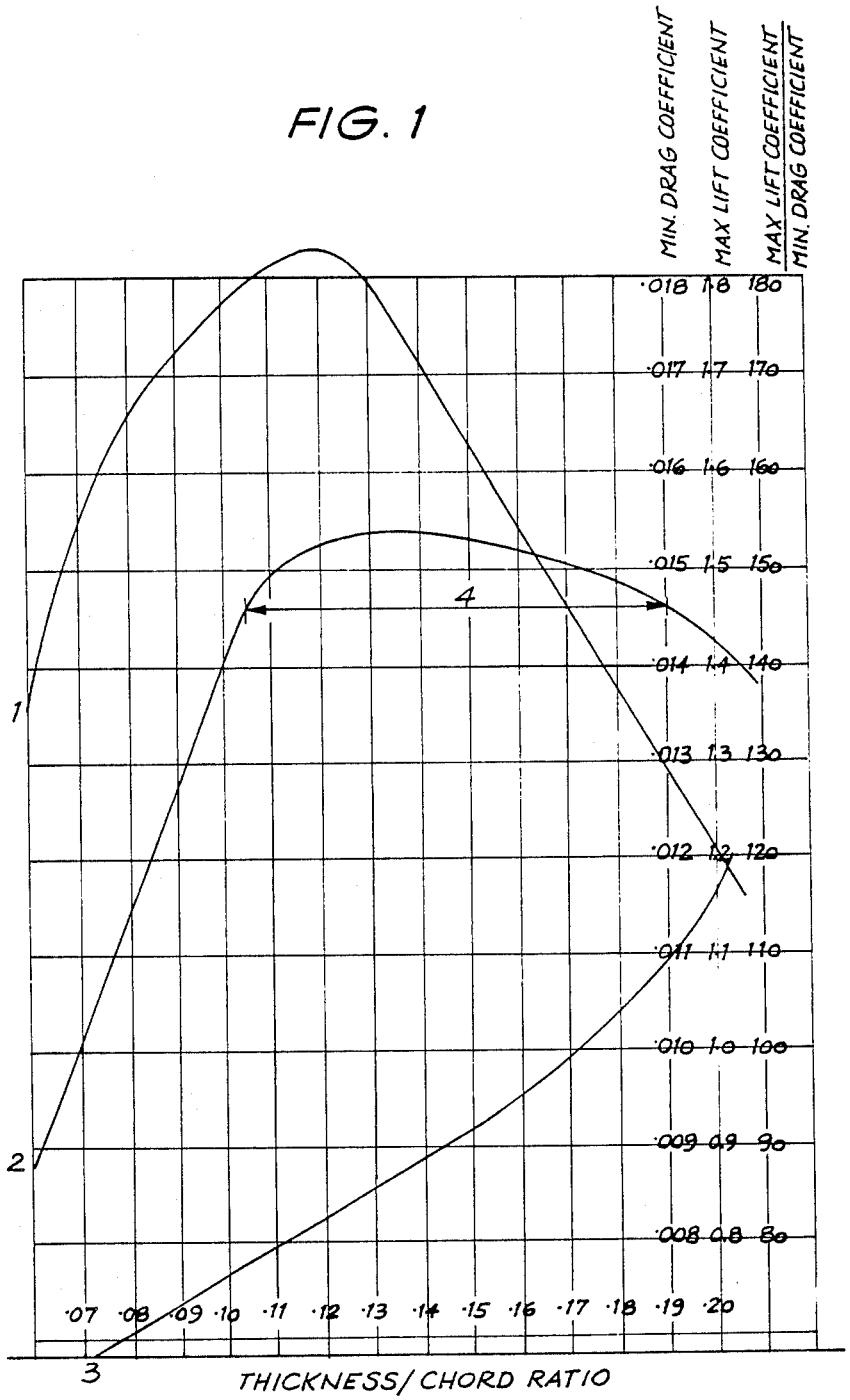
FIG. 1 shows graphical information of keel performance.

Line 1 in FIG. 1 represents the plot of the ratio of the maximum lift coefficient to the minimum drag coefficient, (according to the right hand vertical scale), so a function of the thickness/chord ratio, (according to the horizontal scale), for a typical family of camberless hydrofoils with a maximum thickness at 30% of the chord, from thickness/chord ratio 0.6 to 0.20.

Line 2 in FIG. 1 represents the plot of the maximum lift coefficient, (according to the central vertical scale), as a function of thickness/chord ratio, for the same family of hydrofoils over the same range.

Line 3 in FIG. 1 represents the plot of the minimum drag coefficient, (according as a function of the left hand vertical scale), to thickness/chord ratio for the same family of hydrofoils over the same range.

It is seen from FIG. 1, that a keel constructed so as to have a thickness/chord ratio of 0.08 at the top, with this ratio increasing downward from the top until it was 0.2 at the foot of the keel, would have about 90% as much lift as an untapered one with the optimal lift coefficient at thickness/chord 0.13 to 0.14 and would have about 20% more lift than one with a constant thickness/chord 0.09 (1/11th of the chord). Also from 1 in FIG. 1, since the ratio of the maximum lift coefficient to the minimum drag coefficient averages about 160 over the thickness/-chord range 0.08 to 0.20, the drag penalty paid off the wind by keels with thickness/chord ratios averaging 0.14 over those with constant ratio 0.09, is negligible, especially at the hull speed of the boat where wave making by the hull is the dominant source of drag. The type of keel shown in side elevation in FIG. 2, front elevation in FIGS. 3, 4 and 6, and in plan in FIG. 5, when moving through the water would cause water to be accelerated less near the top of the keel than it would nearer to the foot in order to pass horizontally along its surface, and the inertia of the water, insuring that it tended to move from an area of greater acceleration to one of less acceleration, would impart an upward component to the flow along the lower part of the surface, thus reducing the tendency of the flow to vortex from the foot of the keel and creating a "vorticity trap" in the general area shown at 18—18'—18" in FIG. 3. As will be seen from FIG. 1 negligibly small lift and drag penalties are paid in constructing this vorticity reducing device. Also the ballast can be swung lower in the greater volume within the foot of such a keel than it could in the volume within the foot of a conventional keel. Aerofoil data also shows that the maximum lift/-drag ratio occurs at an angle of attack of about 5° for all camberless sections in the thickness/chord range from 0.08 to 0.20 and the lift coefficient corresponding to this angle of attack is constant at about 0.35 for the same sections in the same thickness/chord range. This fact will be seen to be most important in the light of the following discussions. An alternate embodiment of the invention is shown in FIG. 6 in front elevation. In this version, the thickness/chord ratio starts as before at about 0.08 at the top of the keel but maintains this ratio for about one third to one half of the distance downward from the top and then increases more rapidly than in the case of FIG. 3 until it is about 0.2 at the foot of the keel. This arrangement results in a slightly more commodious trap than the one of FIG. 3 but swings the ballast marginally higher.

Since the lift of a foil is linearly proportional to the density of the medium in which it is operating, as well as to the area of its lifting surface, and is proportional to the square of its speed through the medium, and since the density of water is about $10^3$ that of air, a foil operating in water above its stalling speed, would have about the same lift as a similar foil operating in air with about ten times its lifting surface and about ten times its speed. Thus, above the stalling speed, relatively small lifting surfaces are required in water, and thus quite short chords might be practical in this medium, even at low aspect ratios.

The stalling speed of foils of various chords and sections is of crucial importance in determining the practicality of hydrofoil keels for yachts. Since the coefficient of kinematic viscosity of water is about 1/10th that of air at N.T.P. and is about equal to that of air at 10 atmospheres pressure, the stalling speed of a hydrofoil can be determined by the method used in testing aircraft models in compressed air wind tunnels.

For equivalence between model and aircraft the Reynolds Number, $R=L\cdot V/U$ must be the same for both model and aircraft, where:

L is a major dimension, in this case the chord of the wing,

V is the speed relative to the medium, U is the kinematic viscosity of the medium involved.

That is, for the results to be valid. $L_{model}\cdot V_{model}/U_{model}$ must equal $L_{aircraft}\cdot V_{aircraft}/U_{aircraft}$.

If the kinematic viscosities were the same for both model and aircraft and a 1/10th scale model were tested, the velocities in the tunnel would have to be ten times as great as those at which the aircraft was to operate for the test results to be valid, and in many cases these tunnel velocities are impractical so the air is compressed by a factor equal to the reciprocal of the scale of the model, so that the kinematic viscosity is reduced by the same scale as that of the model.

Then if real aircraft velocities are used in the tunnel, we have $L_{model}=L_{aircraft}/10$ and $U_{model}=U_{aircraft}/10$ and $V_{model}=V_{aircraft}$ so $L_{model}\cdot V_{model}/U_{model}=L_{aircraft}/10\cdot V_{aircraft}/U_{aircraft}/10=L_{aircraft}\cdot V_{aircraft}/U_{aircraft}$.

The results will be valid, and a test result, say a stalling speed obtained for a 1/10th scale model will be valid for the real aircraft. In our problem we must only substitute water for air compressed to ten atmospheres, to see that for equivalence when the keel chord equals the aircraft chord $V_{keel}/U_{keel}$ must equal $V_{aircraft}/U_{aircraft}$. But we know that $U_{keel}$ equals $U_{aircraft}/10$ so $V_{keel}$ must equal $V_{aircraft}/10$. Thus stalling speeds observed for aircraft wings of given chords and sections in air, will be valid when divided by 10 for sections of the same chord in water. Application of the above method to data on the approximate stalling speeds of aircraft wings of various chords and sections and with similar wing loadings, leads to the formulation of a design rule of thumb that the maximum chord of a hydrofoil keel must be less than one quarter of the waterline length of the boat on which it is designed to operate in order to insure that it stalls at a speed comfortably below the hull speed of the boat.

To operate effectively, the hydrofoil keel must be able to generate sufficient left at a low angle of attack where the lift/drag ratio is higher to balance the lateral air force generated by the sails, throughout the wind speed range in which the keel is designed to operate. Maintenance of a low angle of attack is important, not only in reducing the leeway angle of the boat, but equally importantly because the lift/drag ratio of the keel may be up to three times as great at the optimal angle of attack for this ratio as it is at the stalling angle of attack (around 16°), thus leaving a greater percentage of the lift generated by the sails available as net driving force, to propel the boat.

For the lift of the keel to balance the lift of the sails, $L_{keel}=\frac{1}{2}\cdot d_{water}\cdot C_{L\ keel}\cdot A_{keel}\cdot V^2_{keel}=L_{sails}=\frac{1}{2}\cdot d_{air}\cdot C_{L\ sails}\cdot A_{sails}\cdot V^2_{wind}$ where d is the density of the medium involved, V is the speed through the medium (wind being the apparent wind speed), $C_L$ is the lift coefficient, and A is the area of the lifting surface. It will be convenient in the following discussion to express the speed of the wind as a multiple of the hull speed of the boat, and hence of the speed of the keel. That is $V_{wind}=k\cdot V_{keel}$.

Also it will be convenient to express the lift coefficient of the sails as a multiple of the lift coefficient of the keel. $C_{L\ sails}=k'\cdot C_{L\ keel}$. Since the density of water is about 800 times that of air, 800. $C_{L\ keel}\cdot A_{keel}\cdot V^2_{keel}$ must equal $C_{L\ sails}\cdot A_{sails}\cdot k^2\cdot V^2_{keel}$ and $A_{keel}/A_{sails}$ must equal $k'\cdot k^2/800$ or $(C_{L\ sails}/C_{L\ keel})\cdot k^2/800$.

The lift coefficient of the keel depends both on its section and its angle of attack and the lift coefficient of the sails can be adjusted by sheeting variations to give a range of optimal values with respect to lift/drag ratio throughout a given wind speed range. Thus it is possible, by suitably arranging the ratio of keel lifting surface area to sail area, to design a system in which the lift of the sails, over a given wind speed range is balanced by the lift of the keel operating close to that angle of attack which affords the highest lift/drag ratio, thus minimising the keel drag in that wind speed range and maximising the net driving force available to propel the boat. For the lift of a hydrofoil keel to balance, throughout some range of angles of attack close to an optimal angle of attack, the lift of the sails at the upper end of a given wind speed range, the ratio of the area of the lifting surface of the keel to the sail area of the boat on which it is to operate, must be approximately equal to the square of the ratio of the wind speed at the upper end of the wind speed range in which the keel is designed to operate effectively, the hull speed of the boat on which it is designed to operate, multiplied by the ratio of the lift coefficient equivalent to the highest lift/drag ratio of the sails at the upper end of the given wind speed range, to the lift coefficient of the keel at that angle of attack giving its highest lift/drag ratio, all divided by 800. Since a keel having a thickness/average chord ratio increasing from about 0.08 at the top to about 0.2 at the foot gives the highest lift coefficient at this optimal angle of attack, the equilibrium can be maintained by such a keel with a smaller lifting surface than it can with any other.

In accordance with one embodiment of the invention, the various parameters are determined with reference to performance when beating, i.e., sailing close-hauled.

Thus, to achieve optimal performance at any particular apparent wind speed $V_{WIND}$ between about 14 knots and 30 knots, the keel area should be approximately equal to the following quantity:

$$\frac{A_{SAILS}}{800}\left(\frac{V_{WIND}}{V'_{HULL}}\right)^2 \frac{C'_{L(SAILS)}}{C'_{L(KEEL)}}$$

where $A_{SAILS}$ is the lifting surface area of the sail rig, $V'_{HULL}$ is the theoretical maximum hull speed in knots, $C'_{L(SAILS)}$ is the coefficient of lift of the sail rig at the setting giving the highest lift/drag ratio for an apparent wind velocity of 18 knots, and $C'_{L(KEEL)}$ is the lift coefficient of the keel at the angle of attack giving the highest lift/drag ratio at $V'_{HULL}$.

To select a keel area for optimal performance in relatively light air, $V_{WIND}$ might be set at, for example, 14 knots. To select a keel area for optimal performance in relatively heavy winds, $V_{WIND}$ might be assigned the value of 25 knots.

For purposes of specific example, in a yacht designed for optimal performance when beating at an apparent wind speed of 25 knots, having a sail area of approximately 300 square feet, a lift coefficient for the sail rig of 0.4 (at maximum lift/drag ratio for an apparent wind speed of 25), a maximum theoretical hull speed when beating of 4.5 knots, and a keel lift coefficient of 0.35 (at the maximum lift/drag ratio for a hull velocity of 4.5 knots), the keel area would be 13.2 square feet.

Optimal performance between apparent wind speeds of 18 and 21 knots is believed desirable for sailing in certain areas. To achieve this, the keel area should be within the following range:

$$\frac{A_{SAILS}}{800}\left(\frac{18}{V'_{HULL}}\right)^2 \frac{C'_{L(SAILS)}}{C'_{L(KEEL)}} \leqq A_{KEEL} \leqq \frac{A_{SAILS}}{800}\left(\frac{21}{V'_{HULL}}\right)^2 \frac{C'_{L(SAILS)}}{C'_{L(KEEL)}}$$

In a high performance yacht of the type described hereinabove, the hull will generally be operating at or approximately at its theoretical maximum speed so long as the apparent wind speed is greater than about 14 knots. Thus, selection of keel area as set forth above, substituting any desired upper and lower limits for the numbers 18 and 21 in the above equation, should provide optimal performance for any desired range of wind speeds above 14 knots.

Figure 11:
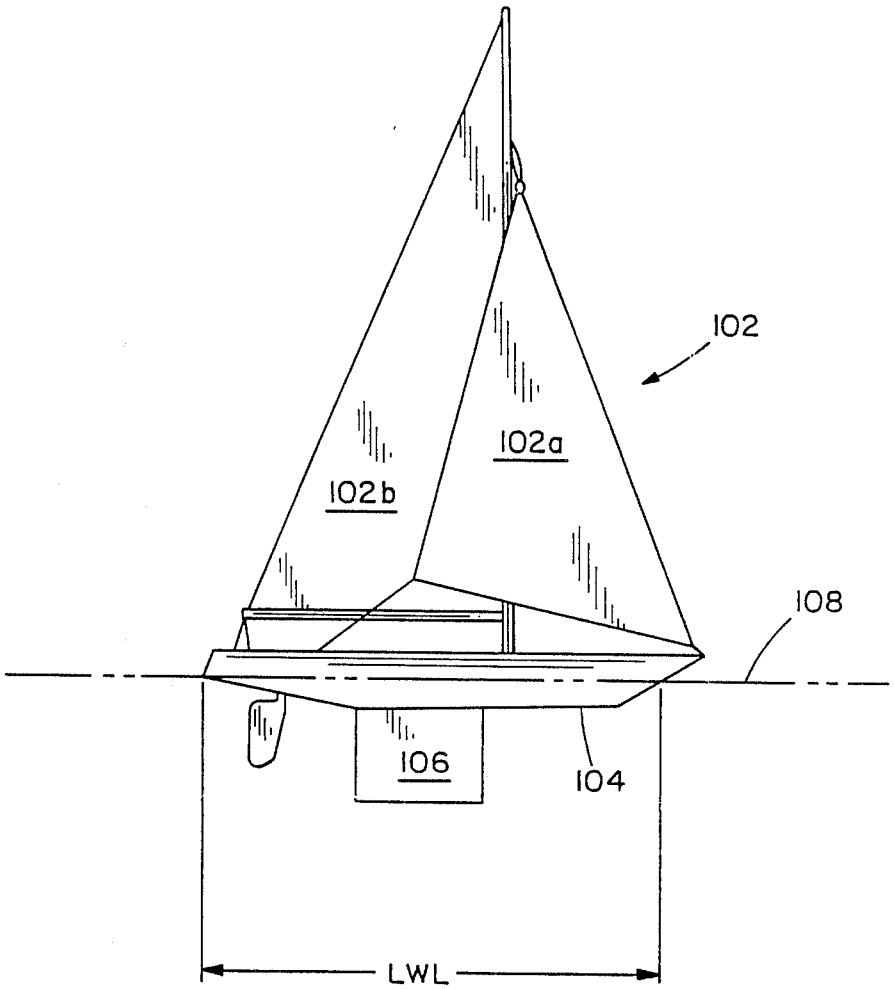
FIG. 11 is a schematic elevational view of a yacht in accordance with the invention.

In order to calculate keel area of a yacht such as that of FIG. 11 in accordance with the foregoing, the area of the sail rig 102 is the sum of the areas of the illustrated foresail 102*a* and mainsail 102*b*, which areas may be readily determined by conventional measurement and calculation. The area of the keel 106 may similarly be determined by measurement and conventional calculation.

The maximum theoretical hull speed (in knots) of a high performance sailing yacht when beating is generally greater than the square root of the loaded water line length (LWL) in feet and should be about 1.2 times the square root of the loaded water line length of the hull in feet. The length of the hull 104 at the waterline 108 may readily be measured, and the theoretical maximum hull speed calculated as set forth above from that measurement. Of course, the actual hull speed at the desired apparent wind speed may, if known, be substituted for the theoretical maximum for purposes of the above calculations.

With respect to the lift coefficients, it will be appreciated by those skilled in the art that for any airfoil or hydrofoil providing aerodynamic or hydrodynamic lift, the lift coefficient and the lift/drag ratio vary as a function of angle of attack. For any given foil section, the lift/drag ratio will have a maximum at a particular angle of attack. $C'_L$ is the lift coefficient at that angle of attack. Data on lift coefficient $C_L$ and lift/drag ratio $C_L/C_D$ are readily available for many airfoil sections. See, e.g., Carter *Simple Aerodynamics*, 5th Ed., 1940, p. 64, which illustrates that for a Clark Y airfoil, $C'_L$ would be about 0.37.

The lift coefficient of the sail rig 102 at the setting which provides the maximum lift/drag ratio may, for some configurations, be known, or otherwise may be empirically determined employing conventional wind tunnel techniques. Similarly, the lift coefficient of the keel at the angle of attack providing the maximum lift/drag ratio, if not available otherwise, may be measured using a test tank.

Boat-sail combinations generated rotational moments when sailing, which because sails, except spinnakers, are sheeted on the leeward side of the boat usually constitute weather moments, known as weather helm, which is balanced by the application of lee helm via the rudder. Under large wind loads the weather helm can become quite large and compensation for it induces significant rudder drag into the system. Hydrofoil keels also generate rotational moments when lifting, so the possibility exists of reducing or even eliminating rudder drag by the systematic controlled use of keel moments when beating. The moment of a hydrofoil keel operating above its stalling speed is measured by $M_{keel}=\frac{1}{2}\cdot d_{water}\cdot C_{M\ keel}\cdot A_{keel}\cdot V^2$ keel and the moment of the boat-sail combination is measured by $M_{sails}=\frac{1}{2}\cdot d_{air}\cdot C_{M\ sails}\cdot A_{sails}\cdot V^2$ wind where $C_{M\ keel}$ is the moment coefficient of the keel and varies with both the angle of attack and the section used. If the coefficient is positive the keel generates weather moments and if it is negative the keel generates lee moments, so to offset the weather helm of the boat the moment coefficient of the keel must be negative. Also, since the angle of attack of the keel is increased by increases in the weather helm of the boat, for stability, the negative value of the moment coefficient of the keel must increase with increases in the angle of attack.

$C_{M\ sails}$ is the moment coefficient of the boat-sail combination which can be given almost any required value when building and sailing by the following devices. When designing, by suitable location of the C.L.R. and the C.E by appropriately positioning the keel and the mast step and by arranging for easy mast step adjustments and sheeting width adjustments. When rigging and suiting, by adjustment of the many parameters involved. When sailing, by sheeting and trim adjustments. Now, for a keel designed according to the above requirements, the moment would be represented by $M_{keel}=\frac{1}{2}\cdot 800\cdot C_{M\ keel}\cdot A_{keel}\cdot V^2$ keel and the moment of the sails at the maximum wind speed in the design range would be $M_{sails}=\frac{1}{2}\cdot C_{M\ sails}\cdot A_{sails}\cdot k^2\cdot V^2_{keel}$. Thus, for equilibrium $C_{M\ sails}/C_{M\ keel}$ must equal $(800/k^2)$. $(A_{keel}/A_{sails})$. But we know from the previous section that $A_{keel}/A_{sails}=k'\cdot k^2/800$. So for equilibrium $C_{M\ sails}/C_{M\ keel}$ must equal $k'=C_{L\ sails}/C_{L\ keel}$ over the wind speed range in which the keel is designed to operate. Thus, if $C_{M\ sails}$ is arranged by means of the devices outlined above to bear approximately the same ratio to $C_{M\ keel}$ as does $C_{L\ sails}$ to $C_{L\ keel}$ for all wind speeds in the design range and the keel section is so selected that $C_{M\ keel}$ is negative throughout the range of angles of attack corresponding to the wind speed range and the differential coefficient of $C_{M\ keel}$ with respect to angle of attack is also negative throughout the same range of angles of attack, the boat will be rotationally stable throughout the design wind speed range and will beat at an angle of attack close to that affording the highest lift/drag ratio for the keel section selected. Note also, that since $M_{sails}$ and $M_{keel}$ come to equilibrium through small adjustments in the angle of attack of the keel it is not necessary for $C_{M\ sails}$ to be exactly equal to $k'/C_{M\ keel}$ over the whole wind speed range involved; as long as it is a reasonably close approximation, once equilibrium is established within range, any change in $M_{sails}$ induced by a change in wind speed, will induce whatever small change is required in the angle of attack of the keel to deliver the required change in $C_{M\ keel}$ to restore the rotational equilibrium. Note also, that the system will be stable under changes in wind direction, any change in M sails due to change in wind direction will induce a change in angle of attack of the keel in the correct sense required to restore rotational equilibrium at the old angle of attack oriented to the new wind direction. With this system operating when beating, the rudder can be neutralised or even withdrawn from the water thus significantly reducing rudder drag, and the boat will automatically beat close to the keel angle of attack affording the highest lift/drag ratio, thus allowing the boat to sail at the highest speed commensurate with the driving force available. Also, since the optimal angle of attack is around 5° for keel of camberless section and is around 0° or even at small negative angles of attack for some cambered sections significantly higher tracks can be attained with this system than can be achieved with conventional keels. However, possibly the greatest advantage of all in the system is that it leaves the crew free to devote its undivided attention to maintenance of the optimal sail setting for the ambient wind conditions, without worrying about variations from the optimal setting of the sail platform due to steering errors.

It is known, for example from aerodynamics, that in general a foil shape having its maximum thickness well towards the leading edge will provide the required negative moment coefficient and negative differential moment coefficient. Also the thickness to chord ratio will influence the negativity of these coefficients. Experiments on a full sized yacht show that the theoretical result holds good in practice.

The reason why the keel angle of attack is optimised for the highest wind speed in the design range and not for the average wind speed in the range, is because at wind speeds corresponding to keel speeds below the hull speed of the boat, a reduction in the wind speed automatically induces a reduction in both $L_{keel}$ and $M_{keel}$ through a reduction in $V^2_{keel}$ and the equilibria will be maintained, leaving both $C_{L\ keel}$ and $C_{M\ keel}$ close to their original values and consequently leaving the keel angle of attack close to its original optimal value.

It should also be noted that for reefed suits of sails $C_{M\ reefed\ sails}$ can be arranged through the many devices available to equal $C_{M\ sails}$ adjusted for the changed sail area, so that rotational equilibrium can be maintained throughout virtually the entire wind speed range.

An alternate method of maintaining rotational equilibrium outside the design wind speed range would be to lock or set the amount of helm required to restore equilibrium on to the rudder and the keel would again function as outlined above, the only penalty paid being the small amount of induced rudder drag.

Figure 10:
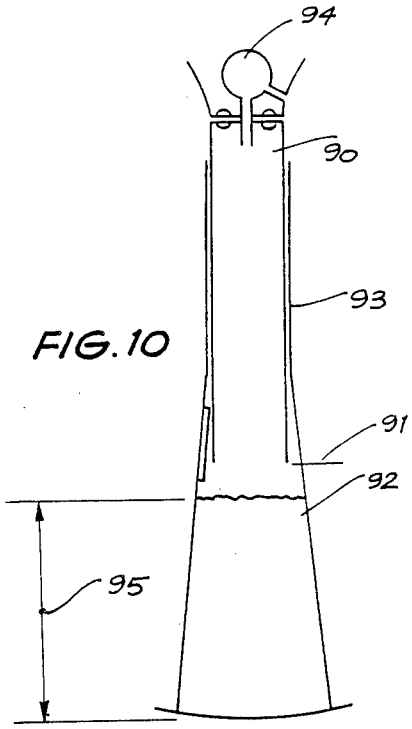
FIG. 10 shows in front sectional elevation a further embodiment of the invention.

For wind speeds outside the design wind speed range the ratio of the area of the keel lifting surface to the sail area to suit the new wind speed range can be obtained by varying the area of the keel lifting surface rather than by reefing the sails. One arrangement for varying the area of the keel lifting surface is shown in FIG. 10 which depicts the variation of the keel shown in FIG. 6 adapted for this function. In this arrangement the keel is constructed in two major parts consisting of: an upper part 90 rigidly fixed to the hull of the boat and extending vertically downward to a level 91, slightly above the maximum ballast level in the keel when the keel is in a configuration according its minimum lifting surface area and with the planform of this upper part 90 being the same as the planform of the vertically sided upper part of the keel shown in FIG. 6 and a lower part 92, having the same general configuration as the lower two thirds or so of the keel of FIG. 6 except that its upper part 93 is shaped to form a sliding sleeve fitting with a waterproof seal outside the vertical sided upper part 90. The sleeve being extended vertically upward to a point where, when the keel is in the configuration affording its lowest lifting surface area, the top of the sleeve 93 is level with the top of upper part 90. The arrangement also requires a two way pressure water pump 94 situated either within the keel or within the boat and able to pass water as required between the watertight compartment within the keel and the water in which the boat is floating. When water is extracted from the watertight compartment in this operation, the pressure of the atmosphere acting through the water outside the keel will raise the lower part, 92, of the keel thus reducing the keel's lifting surface area. Conversely, adding water to the watertight compartment will increase the lifting surface area. Since the atmospheric pressure is equal to a head of about 2'6" of mercury, the system will operate for a depth of lead ballast inside the keel, shown as 95 in FIG. 10, of up to about 3', which for a keel of the configuration in question is more than enough for almost all operational purposes. For very large boats where the depth of the keel is a significant fraction of the head of water which the atmosphere will support, higher maximum ballast depths within the keel can be achieved by locating the two way water pump 94 near the level 91, within the keel, as the water head 91–94 would then be above the pump and not below it. In the above form of the keel the water vents are not desirable, and the ballast manipulation ports, if fitted, must be equipped with waterproof seals. Some restraining means connecting parts 90 and 92, such as chains or cables of appropriate length situated within the keel, must also be fitted to prevent the lower part of the keel from falling away in the event of a pressure failure within the keel.

Figure 2:
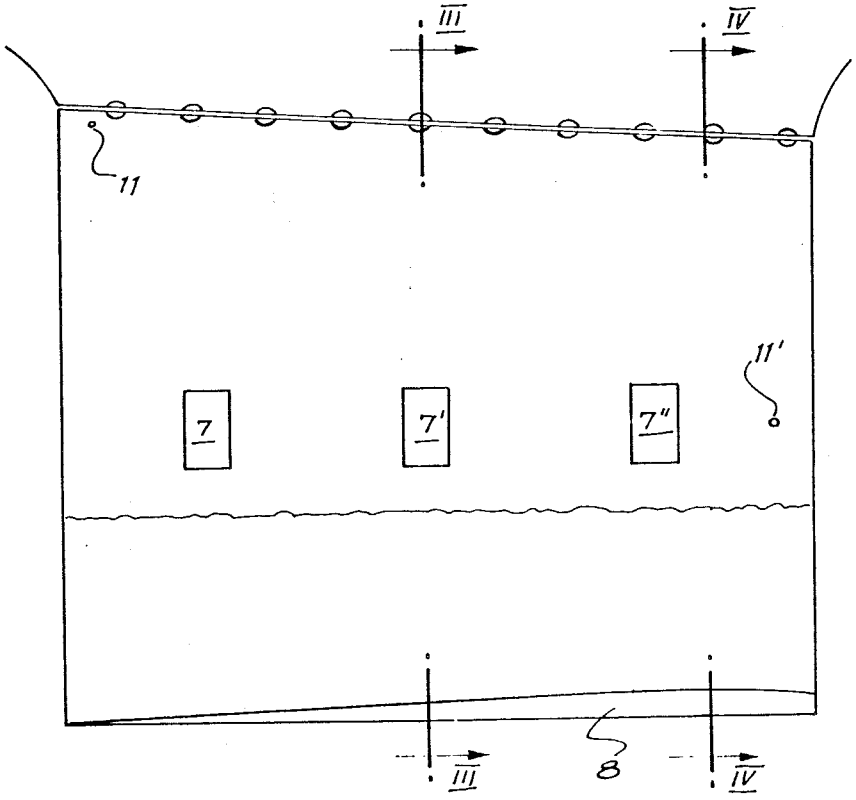
FIG. 2 shows in elevation an embodiment of the invention.
Figure 3:
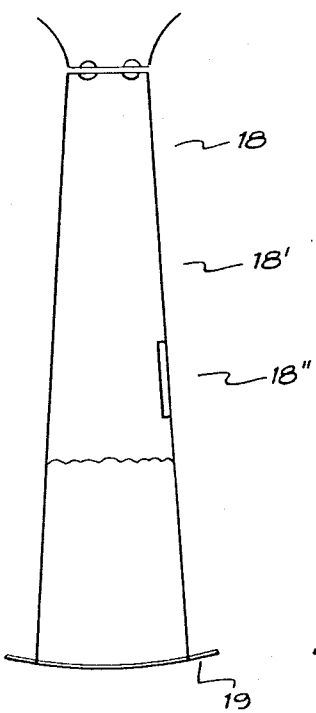
FIG. 3 shows in front sectional elevation the keel of FIG. 2 at line III—III.
Figure 4:
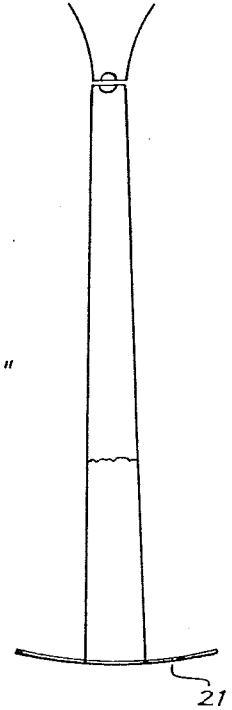
FIG. 4 shows in front sectional elevation the keel of FIG. 2 at line IV—IV.
Figure 5:
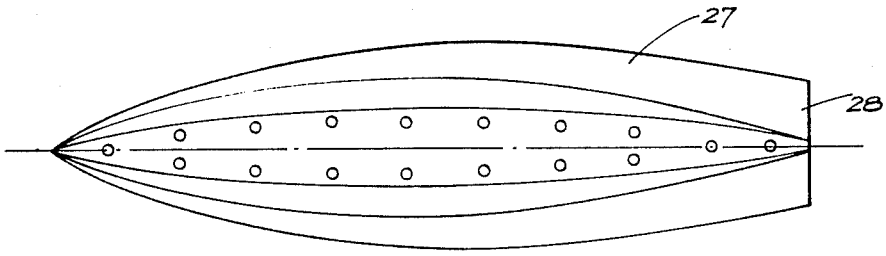
FIG. 5 shows in plan form a further embodiment of the invention.
Figure 6:
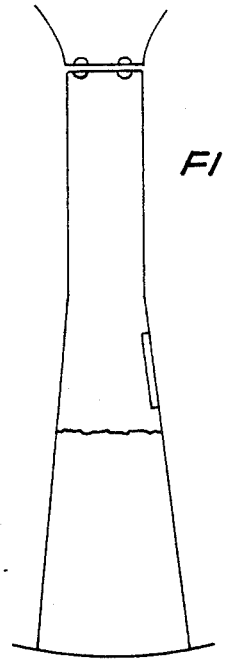
FIG. 6 shows a keel in front elevation illustrating further preferred features of the invention.

Further reduction in vorticity can be effected by placing a rigid plate shown at 8 in FIG. 2, 19 in FIG. 3, 21 in FIG. 4 and 27–28 in FIG. 5, at the foot of the keel. The function of the plate is to form a horizontal barrier between the velocity changed water flowing along the sides of the keel and the relatively unaffected water flowing beneath it, while inducing as little drag as possible in the process. The hydrofoil planform of the plate as shown at 27 in FIG. 5 is designed to afford the best area distribution of the plate for separation, in the flow laterally away from the lower aft surface of the keel, with the increased chord function being introduced to allow for lag due to viscosity, in the water stream laterally away from the keel surface. In front elevation the plate is curved as shown at 19 in FIG. 3 and 21 in FIG. 4 to the arc of a circle centered a little below the center of buoyancy of the boat and of radius extending to the foot of the keel, to ensure that the plate does not increase the draught when the boat is heeled. Of course the plate will not function as a hydrofoil because of its thinness.

A keel in accordance with the present invention would have a much larger volume within its foot than would a conventional keel and so it would be able to carry a given weight of ballast lower than would a conventional one, thus endowing boats to which it was fitted with improved stability. In most cases, not all of the volume available within the keel would be needed to accommodate the amount of ballast required, and in these cases the stability would be optimised by carrying water in the residual space above the ballast. To this end, vents as shown in FIG. 2 at 11 and 11' are incorporated into the keel surface to ensure that water fills the space above the ballast at all times when the boat is floating. Since this water must be in place under all sailing conditions, it must not be removed with the bilge water. Thus the space within the keel must be effectively separated from the bilge. This condition requires that boats to which the above keel is to be fitted must have their hulls shaped so as to incorporate a bilge, separate from and independent of the space within the keel, in an arrangement, one form of which is shown at the tops of FIGS. 2, 3 and 4.

In many cases, especially for yachts racing under multimodal rules, it is advantageous to be able to manipulate the ballast as easily and quickly as possible. To this end, one or more coverable ports or doors are incorporated into the sides of the keel as shown in FIG. 2 at 7, 7' and 7", slightly above the maximum ballast level. Using this device it is possible to manipulate the ballast without slipping the boat, as a diver can perform the job standing on the bottom when the boat is in a place where there is about a foot of water under the keel.

Aerofoil data shows that the maximum lift coefficient, and consequently the total lifting capacity of foils can be increased by up to fifty percent by increasing their camber. The data also shows that the angle of attack at which the maximum lift/drag ratio occurs can be reduced from about 5° for camberless foils to about 0° for suitably cambered ones, while at least maintaining the lift coefficient corresponding to this optimal angle of attack, compared to camberless foils. Thus it will be seen from the previous discussions that cambered foils afford even greater reductions in the yaw angles of beating yachts than do camberless foils, however since the camber of cambered keels must be reversed on going from one tack to the other, camber variation is a prerequisite of cambered keels for yachts. Earlier devices for varying the camber of keels were concerned with varying the full chordal length of the keel as a unit. These designs, incorporating flexible plates supported near their fore and aft edges and extending unsupported for virtually the full chordal length of the section, resulted in plates having unacceptably low rigidities, and cluttered the space within the keel with mechanical components which severely restricted the accommodation available for ballast. According to the present invention it is desirable to have a multisection keel as shown in side elevation in FIG. 8 and in fore and aft section through the mid line in FIG. 7, leaving the mid section as shown at 32 in FIG. 7, intact for the conventional structural and storage functions, and to restrict the cambering and fairing mechanisms to the space available within rotatable fore and aft sections shown at 33 and 34 in FIG. 7, while fairing these sections to the center section with flexible plates as shown at 48 and 52 in FIG. 8, these plates being only a fraction of the overall length of the keel. Using short plates ensures rigidities many times as great as those of plates extending unsupported over the full length of the keel; any further required rigidity can be induced by the application of extra stabilising tension to the plates by hydraulic pistons 65 and 66 in FIG. 9, in the mathematically positioned rods 63 and 64. Extra stability is insured for the plate on the low pressure side in the fully cambered position, by contouring the contiguous surfaces of both the fixed and rotatable sections, as shown at 67 and 68 in FIG. 9 to the required foil section in that area. Pivot shafts carrying the rotatable sections as shown at 35 and 36 in FIG. 7 and at 87 in FIG. 9 are carried on bearings based on the foot of the center section as shown at 38 and 39 in FIG. 7 at their lower ends and on bearings based in the foot of the hull as shown at 40 and 41, at their upper ends. A full description of the fairing device including its method of operation will now be given. FIG. 9 shows in planform a rotatable section, designated 88, of a multi-section variable camber keel and its junction with the fixed center section which is designated 60. 71, 72 and 73 represent the positions of the extreme end of the rotatable section when it is respectively, centered, rotated to its extreme anticlockwise position, and rotated to its extreme clockwise position. When the boat is beating on the starboard tack, if 88 represents the front section it will be rotated until its point is at 72.

This action reduces the camber of the high pressure side of the keel, 72–77–61–74 and increases the camber of the low pressure side 72–77″–62″–75, thus increasing the lift coefficient and hence the lifting capacity of the keel as well as reducing the angle of attack at which the maximum lift/drag ratio occurs. If the boat is on the port tack, the point of 88 will be rotated to 73, thus reversing the camber and optimising the abovementioned parameters for the port tack. The rotatable sections are faired to the center section, so as to enforce prerequired foil sections throughout the range of rotation in the following way. Sheaths, shown at 71–77′ and 71–78′, are fitted covering each side of the front outer surface of the rotatable section, 88, as shown in FIG. 9, parallel with the surface and allowing sufficient space between the sheaths and the rotatable section to accommodate the front parts of flexible plates, shown at 61 and 62 in FIG. 9 with said sheaths extending far enough backwards along, and parallel with, the adjacent surface of the front part of the rotatable section, so that when this section is rotated to its maximum degree to the opposite side of the boat to that on which the particular plate is situated the end of that plate is still well within its sheath.

Figure 8:
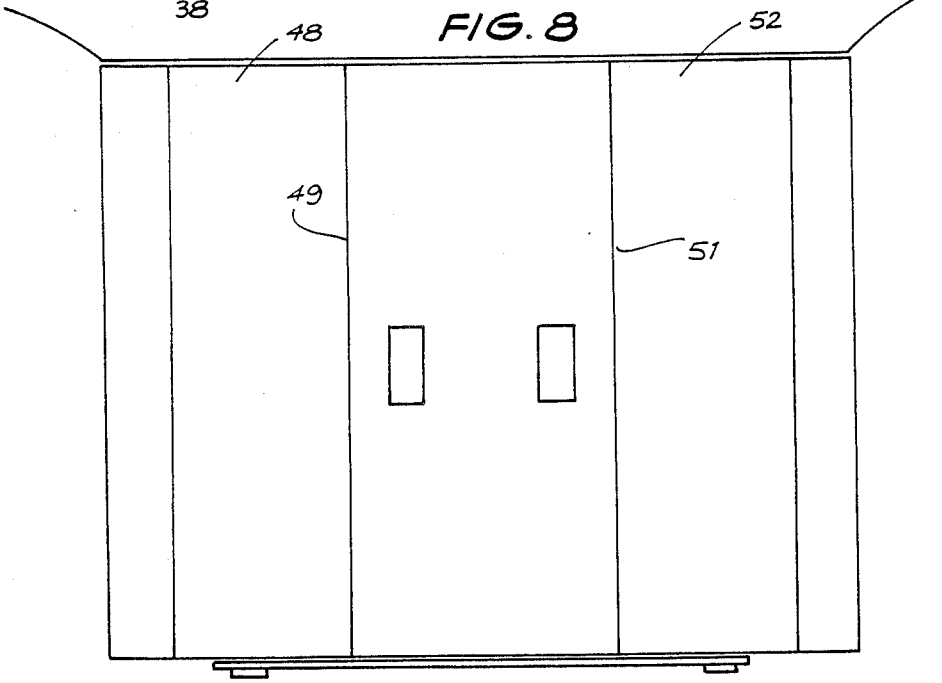
FIG. 8 shows the exterior of the keel of FIG. 7.
Figure 9:
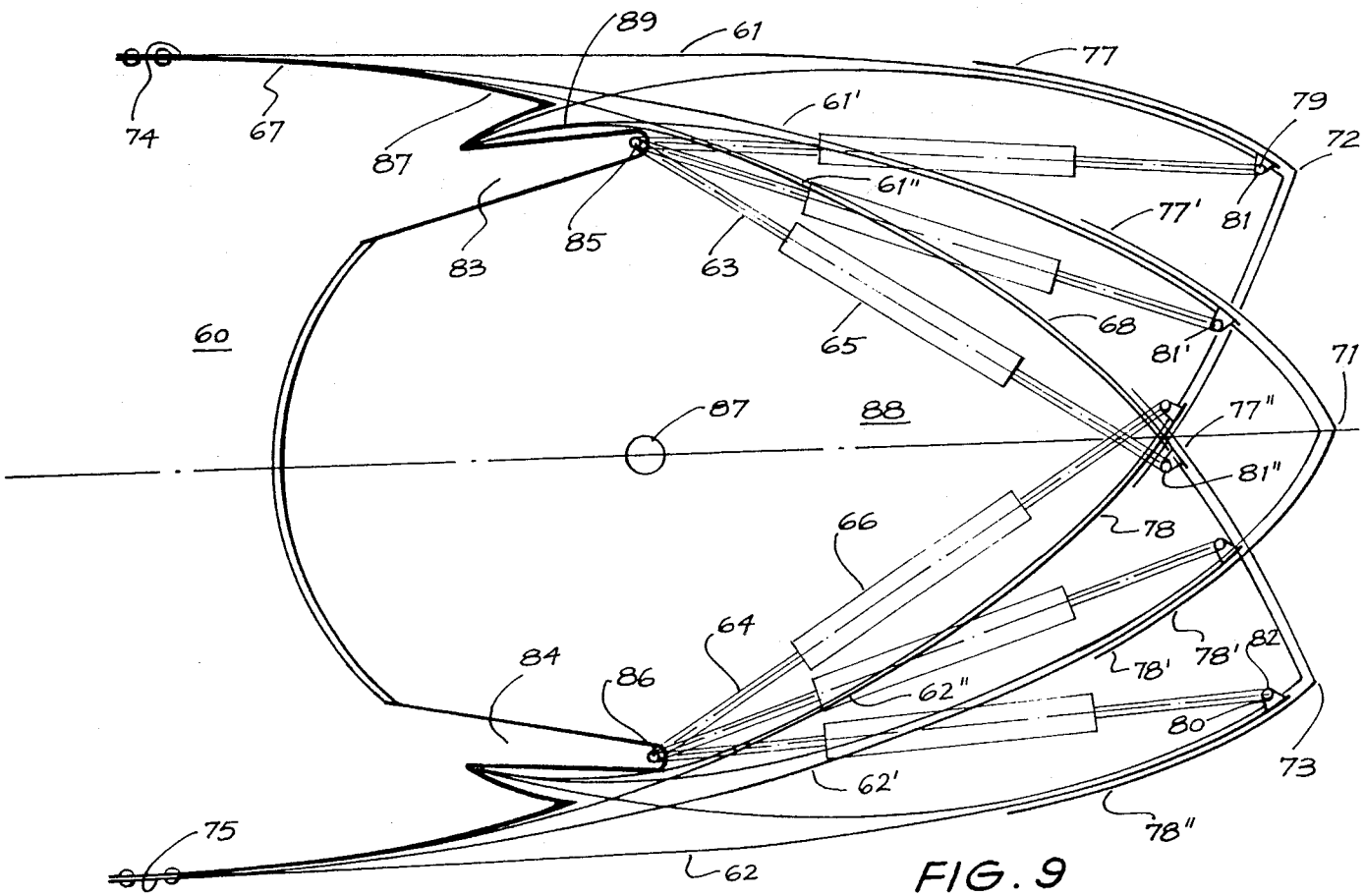
FIG. 9 is an operational schematic view of the keel of FIGS. 7 and 8.

These flexible plates are fixed vertically along their aft ends along positions represented by the lines 49 and 51 in FIG. 8, and their front ends are shaped to conform to the front vertical foreline of the front section, with their horizontal lengths being arranged so that their front ends come as close as may be required to the vertical foreline of the front section, when the front end of that section is rotated to its maximum extent, to the side on which the particular plate is situated, and when the plate is curved to conform to the prerequired foil section in that position. Near the front ends of the flexible plates, short processes are fixed at vertical intervals, as shown at 79 and 80 in FIG. 9, extending inward through slots in the surface of the rotatable section, carrying bearings near their inner ends as shown at 81 and 82 in FIG. 8, said slots extending far enough horizontally to allow free rotation of the rotatable section to its maximum required extent. Other processes corresponding vertically to those previously defined, extend forward from the center section as shown at 83 and 84 in FIG. 9 through other slots in the rotatable section which also extend far enough horizontally to allow free rotation of that section to its maximum required extent. These processes from the center section also carry bearing near their front ends as shown at 85 and 86 in FIG. 9, said bearings being connected through pivots to the rods shown at 63 and 64 in FIG. 9 which rods connect them through pivots to the corresponding bearings in the processes from the flexible plates, shown at 81 and 82. The positioning of the bearings represented by 85 and 86 is of crucial importance to the functioning of the whole device, so their method of location and their function will now be dealt with. As the rotatable section, 88, is moved so that its point moves from 72 through 71 to 73, while the plate 61 in conjunction with the sheath 77–72 passes through a prerequired series of faired curves 72–77–61–74 through 71–77′–61′–74 to 73–77″–61″–74 the locus of the pivot bearing 81, is a curve 81—81′—81″ in the horizontal plane, as seen from FIG. 9, which since the average curvature difference between 72–77–61–74 and 81″–61″–74 is small compared with the length of the flexible plate, will closely approximate the arc of a circle passing through 81, 81′ and 81″. The center of this circle can be found by the usual geometric means, and having found this point the center for a circle which even more closely fits the established locus can be found by trial and error within a circle of a mm or so radius around it. Actually, for a reason to be elaborated later it is better to have 85–81 equal to 85–81″ with 85–81′ marginally shorter, so the center for a circle should be found passing through 81 and 81″ and passing as close inside 81′ as possible. When the center for the pivot bearing 85 is found in this way and the rod 63 of length between the centers of its pivots equal to the radius of the circle, is fitted as shown, the forms 72–77–61–74 through 71–77′–61′–74 to 73–77″–61″–74 are infinitely repeatable as the rotatable section is rotated from side to side during beating operations. When designing a keel, no great problem is involved in impressing any series of forms required for a given operational purpose, on the above series. When the point of the rotatable section is at 73, plate 61 forms part of the low pressure surface and is in contact with the surfaces of both the fixed and rotatable sections for almost its entire length so any prerequired foil form can be enforced in that position by profiling the surface of the center section 74 to 87 and the surface of the rotatable section from 89 to 73 to the required form. When 61 forms part of the high pressure surface, that is when the point of 88 is at 72, virtually any prerequired form can be enforced by a combination of the following devices, (1) By suitably contouring the part of the surface of the rotatable section which is contiguous with the sheath.

(2) By suitable adjusting the distance 72–77 which the sheath is carried aft.

(3) By suitable location of the fore and aft location of the fixing point 74.

(4) By suitable adjustment of the maximum angle of rotation of the rotatable section.

(5) By suitable adjustment of the percentage of the chordal distance at which the pivot shaft, shown as 87 is located.

When the boat is off the wind, the rotatable section would be rotated to the neutral position, 71, where the keel is not lifting and its chief required attribute is minimum drag. This attribute is determined by the thickness/chord ratio, the slickness of the surface and the foil forms near the entry and exit, but is not significantly altered by small variations in the form 71–77′–61′–74 so the pivot point 81′ does not have to be quite as accurately enforced as 81 and 81″.

Any further required stabilising tension for the plates 61 and 62 can be applied through the hydraulic pistons shown at 65 and 66 in the rods 63 and 64 in FIG. 9 such pistons being controlled from inside the boat through hydraulic lines passing through the slots in 60 which accommodate the rotation of 88 past 83 and 84. Preferably the hydraulic pistons 65 and 66 are controllable in both compression and tension.

Figure 7:
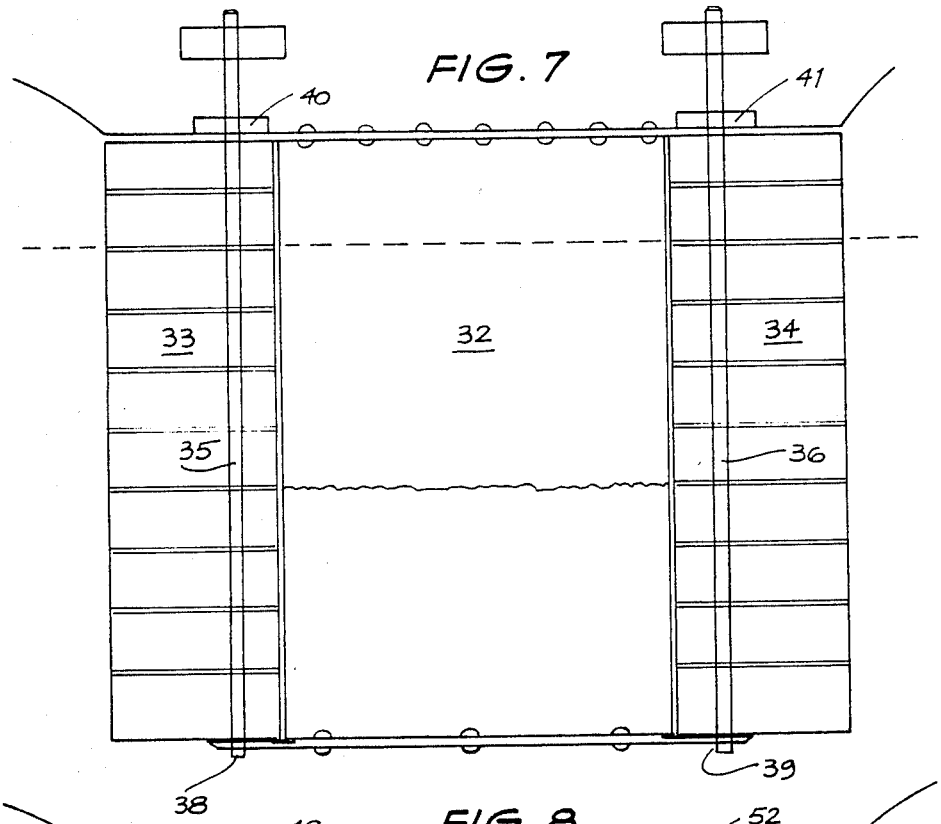
FIG. 7 shows an internal view of an embodiment including further features of the invention.

As shown in FIG. 7, the stabilising assemblies described above are repeated as often as necessary to achieve the surface rigidity required, at suitable intervals from the top of the keel to the bottom.

The beforehand description should be sufficient for those familiar with the art of hydrodynamics to produce a keel of the desired shape to gain the benefits of the present invention, however further reference may be had to the following publications. Aerodynamics of the Aeroplane (W. L. Cowly) and Theory of Wing Sections (Ira H. Abbott and Albert E. von Doenhoff).

What I claim is:

1. In a high performance sailing boat having a sail rig designed to operate in a range of wind speeds up to an upper designed wind speed and a displacement hull with a hull speed being the maximum theoretical speed of the hull when heating, a keel having hydrofoil shape and a lifting surface area aproximately equal to the sail area of the sail rig multiplied by the square of the ratio of the upper designed wind speed to the hull speed, and further multiplied by the ratio of the lift coefficient of the sail rig at its setting giving the highest lift/drag ratio at the upper designed wind speed to the lift coefficient of the keel at the angle of attack giving its highest lift/-drag ratio all divided by 800.

2. A keel as defined in claim 1, the thickness/average chord ratio at a top end being about 0.08 and increasing to up to 0.20 at the foot of said keel.

3. A keel as defined in claim 1 wherein the cord is less than approximately one quarter of the waterline length of the sailing boat on which it is to operate.

4. A keel as defined in claim 1 wherein the ratio of the moment coefficient of said keel, at that angle of attack giving its highest lift/drag ratio, to the moment coefficient of the boat-sail combination at the sail setting giving the highest lift/drag ratio at said upper designed wind speed, is approximately equal to the ratio of the lift coefficient of the keel at said angle of attack giving its highest lift/drag ratio, to the lift coefficient of the sails equivalent to their highest lift/drag ratio at said upper designed wind speed.

5. A keel as defined in claim 1 wherein the moment coefficient is negative throughout the range of angles of attack in which it is designed to operate.

6. A keel as defined in claim 5 wherein the differential coefficient of the moment coefficient with respect to angle of attack is negative throughout the range of angles of attack in which the keel is designed to operate.

7. A keel as defined in claim 1 incorporating at least one vent, either closable or permanently open, so placed that water can be made to fill the space within the keel above ballast held within the keel when the boat is floating.

8. A keel as defined in claim 1 incorporating one or more coverable ports or doors somewhat above a maximum ballast level of the keel.

9. A keel as defined in claim 1 being attached to a craft, the rudder of which is provided with a fixing or setting means whereby the rudder helm can be fixed to any required degree of weather helm, of lee helm or to zero helm.

10. A keel as defined in claim 1 wherein the area of the lifting surface is variable.

11. A keel as defined in claim 10 comprising: a first hydrofoil shaped portion adapted to be fixed to a boat hull; a second hydrofoil shaped portion telescopically attached to said first portion; and means adapted to controllably extend and retract said first and second portions relative to one another.

12. A keel as defined in claim 11 wherein said first portions is of hollow constant section along the direction of telescopic movement, said second portion includes a sleeve of constant section fitting over said first portion and said keel further including sealing means between said first and second portions and a pump controlling the volume of water within said keel.

13. A keel as defined in claim 12 further comprising restraining means imposing a maximum extension of said first and second portions relative to one another.

14. A high-performance yacht comprising a sail rig, a hull supporting said sail rig, and a keel supported by said hull and extending downward therefrom;

said hull being a displacement hull with a theoretical maximum hull speed in knots when beating of about 1.0 to 1.2 times the square root of the hull water line length in feet; said keel having a hydrofoil shape and having a lifting surface area $A_{KEEL}$ within the following range:

$$\frac{A_{SAILS}}{800}\left(\frac{18}{V'_{HULL}}\right)^2 \frac{C_{L(SAILS)}}{C_{L(KEEL)}} \leqq$$

$$A_{KEEL} \leqq \frac{A_{SAILS}}{800}\left(\frac{21}{V'_{HULL}}\right)^2 \frac{C_{L(SAILS)}}{C_{L(KEEL)}}$$

where $A_{SAILS}$ is the lifting surface area of the sail rig, $V'_{HULL}$ is is the theoretical maximum hull speed in knots, $C'_{L(SAILS)}$ is the coefficient of lift of the sail rig at the setting giving the highest lift/drag ratio for an apparent wind velocity between 18 knots, and 21 knots and $C'_{L(KEEL)}$ is the lift coefficient of the keel at the angle of attack giving the highest lift/drag ratio at a speed of $V'_{HULL}$.

* * * * *

UNITED STATES PATENT AND TRADEMARK OFFICE

CERTIFICATE OF CORRECTION

PATENT NO. : 4,883,011

DATED : November 28, 1989

INVENTOR(S) : IMPROVED HYDROFOIL KEEL

It is certified that error appears in the above-identified patent and that said Letters Patent is hereby corrected as shown below:

Title page:

Foreign document listing, line 5, United Kingdom Patent 125,378, change the date "of 1919" to --4/1919--.

Abstract, line 1, "ia" should be --is--. .

Abstract, line 11, "cordal" should be --chordal--.

Column 1, line 56, "chamber" should be --camber--.

Column 2, line 50, "so" should be --as--.

Column 2, line 60, "as a function of" should be --to--.

Column 2, line 61, "to" should be --as a function of--.

Column 4, line 23, "$V_{aircraft/Uaircraft}$" should be --$V_{aircraft/U_{aircraft}}$--.

Column 4, line 38, "left" should be --lift--.

Column 4, line 39, "higher" should be --highest--.

Column 4, line 63, "800." should be --800.--.

Column 7, line 4, "$V^2$keel" should be --$V^2_{keel}$--.

Column 7, line 6, "$V^2$wind" should be --$V^2_{wind}$--.

Column 7, line 21, "C.E" should be --C.E.--.

Column 7, line 28, "$V^2$keel" should be --$V^2_{keel}$--.

Column 7, line 59, "M sails" should be --$M_{sails}$--.

Column 8, line 53, "according" should be --affording--.

Column 11, pages 52-53, "bearing" should be --bearings--.

UNITED STATES PATENT AND TRADEMARK OFFICE

CERTIFICATE OF CORRECTION

PATENT NO. : 4,883,011

DATED : November 28, 1989

INVENTOR(S) : IMPROVED HYDROFOIL KEEL

It is certified that error appears in the above-identified patent and that said Letters Patent is hereby corrected as shown below:

Column 12, line 27, after "section" insert --from--.

Column 12, line 36, "suitable" should be --suitably--.

Claim 1, column 13, line 10, "heating" should be --beating--.

Claim 12, column 14, line 15, "portions" should be --portion--.

Claim 14, column 14, line 43 [line 2 following formula]; delete "is" (second occurrence.)

Claim 14, column 14, line 47 [line 6 following formula]; "knots, and 21 knots" should be --knots and 21 knots,--.

Signed and Sealed this

Twentieth Day of August, 1991

*Attest:*

*Attesting Officer*

HARRY F. MANBECK, JR.

*Commissioner of Patents and Trademarks*